US006971140B2

(12) United States Patent
Kim

(10) Patent No.: US 6,971,140 B2
(45) Date of Patent: Dec. 6, 2005

(54) BRUSH ASSEMBLY OF CLEANER

(75) Inventor: Se Wan Kim, Seoul (KR)

(73) Assignee: LG Electronics Inc., Seoul (KR)

( * ) Notice: Subject to any disclaimer, the term of this patent is extended or adjusted under 35 U.S.C. 154(b) by 303 days.

(21) Appl. No.: 10/331,882

(22) Filed: Dec. 31, 2002

(65) Prior Publication Data

US 2004/0074039 A1 Apr. 22, 2004

(30) Foreign Application Priority Data

Oct. 22, 2002 (KR) ..... 10-2002-0064684

(51) Int. Cl.[7] ..... A47L 9/04; A47L 11/24; A46B 7/10

(52) U.S. Cl. ..... 15/319; 15/41.1; 15/82; 15/383

(58) Field of Search ..... 15/319, 363, 383, 15/386, 389, 104.03, 104.04, 41.1, 49.1, 15/52.1, 82; 700/245

(56) References Cited

U.S. PATENT DOCUMENTS

| | | | | |
|---|---|---|---|---|
| 1,643,823 A * | 9/1927 | Sever et al. | 15/383 |
| 2,536,902 A * | 1/1951 | Beckett | 15/345 |
| 3,979,788 A * | 9/1976 | Strausak | 15/1.7 |
| 5,109,566 A * | 5/1992 | Kobayashi et al. | 15/319 |
| 5,440,216 A * | 8/1995 | Kim | 318/587 |
| 5,634,237 A * | 6/1997 | Paranjpe | 15/319 |
| 6,594,844 B2 * | 7/2003 | Jones | 15/49.1 |
| 2002/0112899 A1 * | 8/2002 | Dijksman et al. | 180/7.1 |
| 2003/0028993 A1 * | 2/2003 | Song et al. | 15/319 |

FOREIGN PATENT DOCUMENTS

| | | |
|---|---|---|
| DE | 2722653 | * 11/1978 |
| JP | 56-57427 | 5/1981 |
| JP | 11-282533 | 10/1999 |
| JP | 11-318779 | 11/1999 |
| WO | WO 00/78201 | * 12/2000 |

OTHER PUBLICATIONS

English Language Abstract of JP56-57427.
English Language Abstract of JP 11-282533.
English Language Abstract of 11-318779.

* cited by examiner

*Primary Examiner*—Terrence R. Till
(74) *Attorney, Agent, or Firm*—Greenblum & Bernstein, P.L.C.

(57) ABSTRACT

In a brush assembly of a cleaner including plural brushes arranged at the bottom surface of a cleaner body radially at regular intervals; plural supporting shafts for rotatively supporting the brushes; and a driving unit connected to the brushes in order to rotate the brushes, by arranging the plural brushes radially, dust and filth can be collected in a wider region, and accordingly a cleaning performance can be improved. In addition, by forming the brushes as a curved shape, it is possible to compact a size of the cleaner.

16 Claims, 4 Drawing Sheets

BRUSH ASSEMBLY OF CLEANER

BACKGROUND OF THE INVENTION

1. Field of the Invention

The present invention relates to a brush assembly of a cleaner, and in particular to a brush assembly of a cleaner which is capable of improving a cleaning performance by arranging brushes radially.

2. Description of the Prior Art

In general, a robot cleaner cleans while moving by itself without user's operation. When power of the cleaner is consumed, the cleaner moves to a charge battery and charges by itself, after completing the charging it returns to a cleaning area and performs cleaning operation continually.

FIG. 1 is a sectional view illustrating a robot cleaner in accordance with the conventional art.

The robot cleaner includes a cleaner body 102; a suction motor 104 disposed in the cleaner body 102 and generating a suction force; a filter container 108 arranged on the front of the suction motor 104 and having a filter 106 in order to collect dust or filth by the suction motor 104; a suction hole 112 formed at the bottom of the cleaner body 102 so as to be connected to the filter container 108 through the suction pipe 110 in order to suck dust or filth on a floor 150; a brush 114 rotatively installed at a side of the suction hole 112; and a control unit 116 for performing cleaning operation by moving the cleaner automatically.

An ultrasound wave transmitter 118 for transmitting ultrasound waves in moving of the cleaner body 102 and an ultrasound wave receiver 120 for receiving ultrasound waves from the ultrasound wave transmitter 118 are installed at the front of the cleaner body 102. And, a charge terminal 122 is installed at the rear of the cleaner body 102, the charge terminal 122 is contacted to a connection terminal 126 installed on a wall surface 124 in a room, and accordingly a charge battery 128 can be charged.

A luminous unit 140 for inducing the charge terminal 122 to the contact terminal 126 is installed at the rear of the cleaner body 102, and a light receiving unit 142 for receiving optical signals generated at the luminous unit 140 is installed on the indoor wall surface 124 at which the contact terminal 126 is installed.

A driving roller 130 operated according to a signal of the control unit 116 and an assist roller 132 for supporting the rear of the cleaner body 130 are installed at the bottom portion of the cleaner body 102.

The brush 114 is for sweeping up dust or filth on a floor, a hinge shaft 136 is connected to a side of the suction hole 112 so as to be rotatively supported the brush, and the hinge shaft 136 is connected to a driving unit (not shown).

The operation of the cleaner in accordance with the conventional art will be described.

When a user pushes an operation button, power of the charge battery 128 is transmitted to the suction motor 104, and the suction motor 104 is operated. By the driving force of the suction motor 104, a suction force is generated, dust and filth on the floor are sucked into the suction hole 112 and are collected in the filter 106 through the suction pipe 110. Herein, the brush 114 sweeps up dust and filth on the floor into the suction hole 112. And, the driving roller 130 is operated according to a signal applied from the control unit 116, the cleaner body 102 is moved, and accordingly the cleaning operation is performed automatically.

The cleaner body 102 can avoid obstacles by the operation of the ultrasound wave transmitter 118 and the ultrasound wave receiver 120 arranged on the front of the cleaner body 102.

While performing the cleaning operation, when a voltage level of the charge battery 128 is not greater than a certain set level, the control unit 116 stops the cleaning operation, moves the cleaner body 102 to the wall surface 124 at which the contact terminal 126 is installed, connects the charge terminal 122 formed at the rear of the cleaner body 102 to the contact terminal 126, and accordingly the charge battery 128 can be charged.

When the charge is completed, the control unit 116 separates the charge terminal 122 from the contact terminal 126 and performs the cleaning operation again.

However, in the conventional cleaner, because it has to sweep up filth on the floor with one brush, when filth is big, it is difficult to sweep and suck the filth. In addition, if there are lots of filth, it is difficult to sweep up them all, and accordingly a cleaning performance may be lowered.

In addition, by installing a brush at a suction hole for sucking dust and filth straightly, a filth sweep region of the brush is small, and accordingly a cleaning efficiency may be lowered.

SUMMARY OF THE INVENTION

In order to solve the above-mentioned problem, it is an object of the present invention to provide a brush assembly of a cleaner which is capable of improving a cleaning performance by collecting dust and filth in a wider region by arranging plural brushes radially.

In addition, it is another object of the present invention to provide a brush assembly of a cleaner which is capable of compacting a size of a cleaner by reducing an installation area of brushes by forming the brushes as a curved shape.

In order to achieve the above-mentioned objects, a brush assembly of a cleaner in accordance with the present invention includes plural brushes arranged at the bottom surface of a cleaner body radially at regular intervals; plural supporting shafts for rotatively supporting the brushes; and a driving unit connected to the brushes for rotating the brushes.

A suction hole is formed at the bottom center of the cleaner body in order to suck dust and filth, and plural installation grooves are formed at the circumference of the suction hole at regular intervals in order to install the plural brushes.

Each brush has a curved surface shape and is made of flexible material so as to be transformed and be strong against twist.

Each brush consists of a brush hub rotatively inserted into the supporting shaft; and brush hair arranged on the outer circumference of the brush hub in order to guide dust and filth into the suction hole.

The plural brushes consist of three brushes arranged at the bottom surface of the cleaner body in the circumferential direction at regular intervals.

The supporting shaft is formed as a curved shape, and both ends thereof are fixed to the bottom surface of the cleaner body.

Lubricant is filled between the supporting shaft and the brush hub in order to smooth the rotation of the brush.

The driving unit includes a driving motor fixed to a certain side of the cleaner body for generating a driving force; and a power transmitting unit connected between the driving motor and the brush in order to transmit the driving force of the driving motor to the brush.

The power transmitting unit includes a driving pulley fixed to the rotational shaft of the driving motor; a driven pulley fixed to the brush; and a belt wound between the driving pulley and the driven pulley.

In a robot cleaner having a suction hole formed at the bottom center of a cleaner body, performing cleaning operation while moving by itself and charging a charge battery automatically, a brush assembly of a cleaner in accordance with the present invention includes plural brushes arranged radially in the outer circumferential direction of a suction hole with a certain interval from the suction hole; plural supporting shafts in which the brushes are inserted respectively in the length direction for supporting the brushes rotatively; and a driving unit connected to the brushes in order to rotate the brushes.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE PREFERRED EMBODIMENT

Hereinafter, embodiments of a brush assembly of a robot cleaner in accordance with the present invention will be described with reference to accompanying drawings.

There can be plural embodiments, hereinafter the preferred embodiment will be described.

Figure 1:
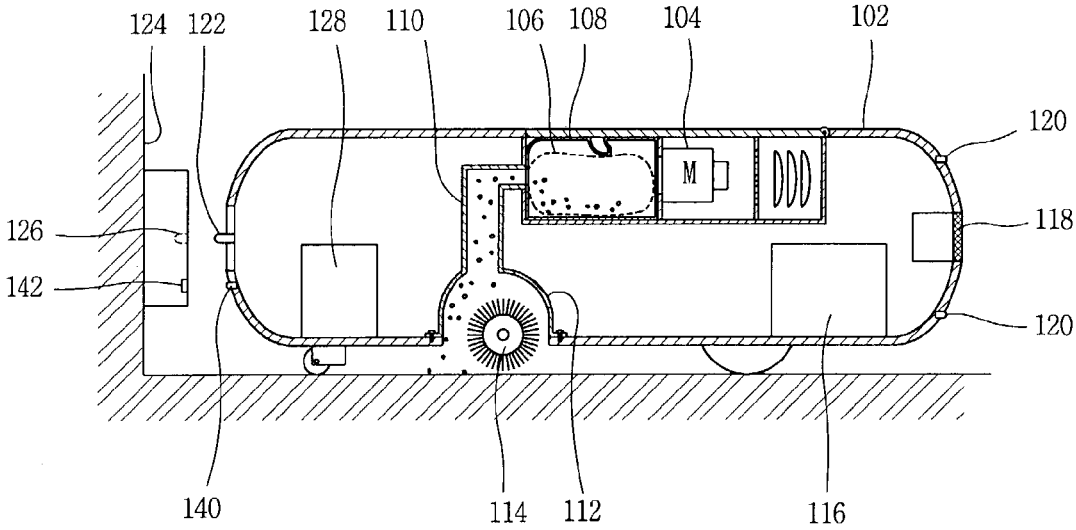
FIG. 1 CONVENTIONAL ART
FIG. 1 is a sectional view illustrating a robot cleaner in accordance with the conventional art.
Figure 2:
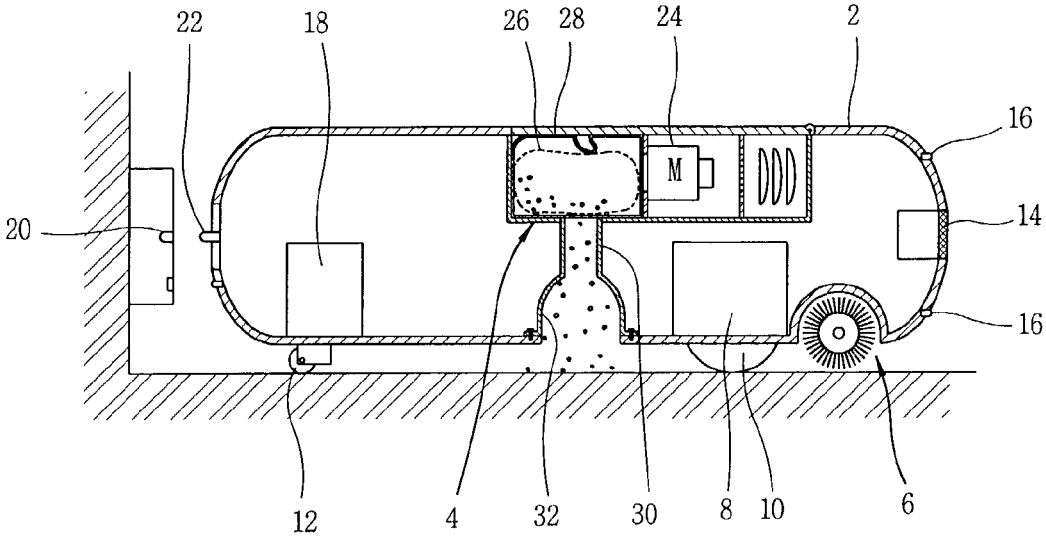
FIG. 2 is a sectional view illustrating a robot cleaner in accordance with the present invention.
Figure 3:
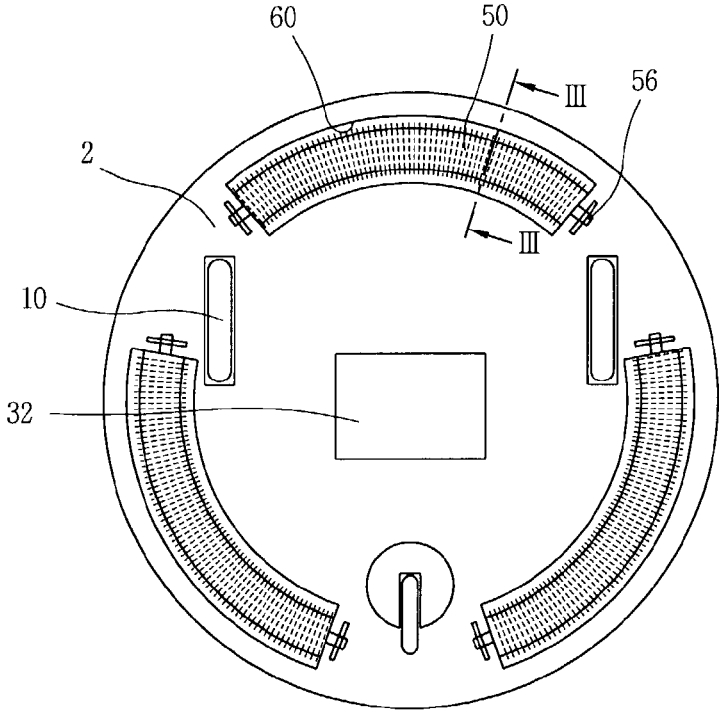
FIG. 3 is a bottom view illustrating the robot cleaner in accordance with the present invention.

FIG. 2 is a sectional view illustrating a robot cleaner in accordance with the present invention.

The robot cleaner in accordance with the present invention includes a cleaner body 2 having a certain space; a suction unit 4 disposed in the cleaner body 2 in order to suck and collect dust on a floor; a brush assembly 6 installed radially at the bottom surface of the cleaner body 2 for taking off dust and filth on a floor in a wide region and guiding the filth and dust into the suction unit 4; and a control unit 8 for controlling the cleaner.

A driving roller 10 operated according to a signal of the control unit 8 and an assist roller 12 for supporting the rear of the cleaner body 2 are installed at the bottom portion of the cleaner body 2.

And, an ultrasound wave transmitter 14 for transmitting ultrasound waves in moving of the cleaner body 2 and an ultrasound wave receiver 16 for receiving ultrasound waves from the ultrasound wave transmitter 14 are installed at the front of the cleaner body 2. And, a charge terminal 22 is installed at the rear of the cleaner body 2, the charge terminal 22 is contacted to a connection terminal 20 installed on a wall surface in the room, and accordingly a charge battery 18 can be charged.

The suction unit 4 includes a suction motor 24 disposed in the cleaner body 2 for generating a suction force; a filter container 28 connected to the suction motor 24 and having a filter 26 to collect dust and filth; and a suction hole 32 formed at the bottom center of the cleaner body 2 so as to be connected to the filter container 28 through the suction pipe 30 in order to suck dust and filth.

Figure 4:
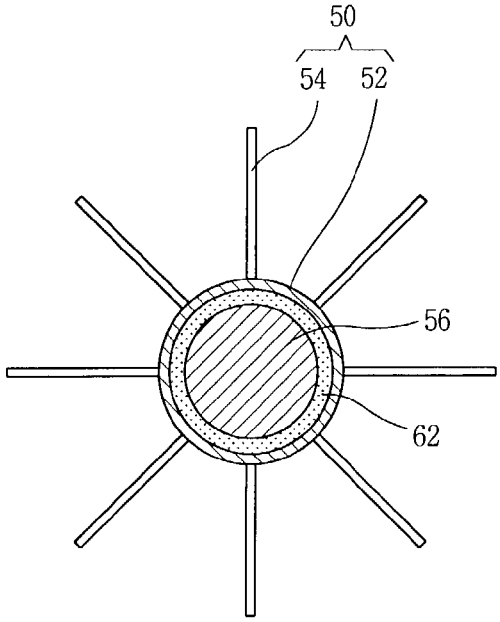
FIG. 4 is a sectional view illustrating a structure of a brush assembly taken along the line III—III in FIG. 3.
Figure 5:
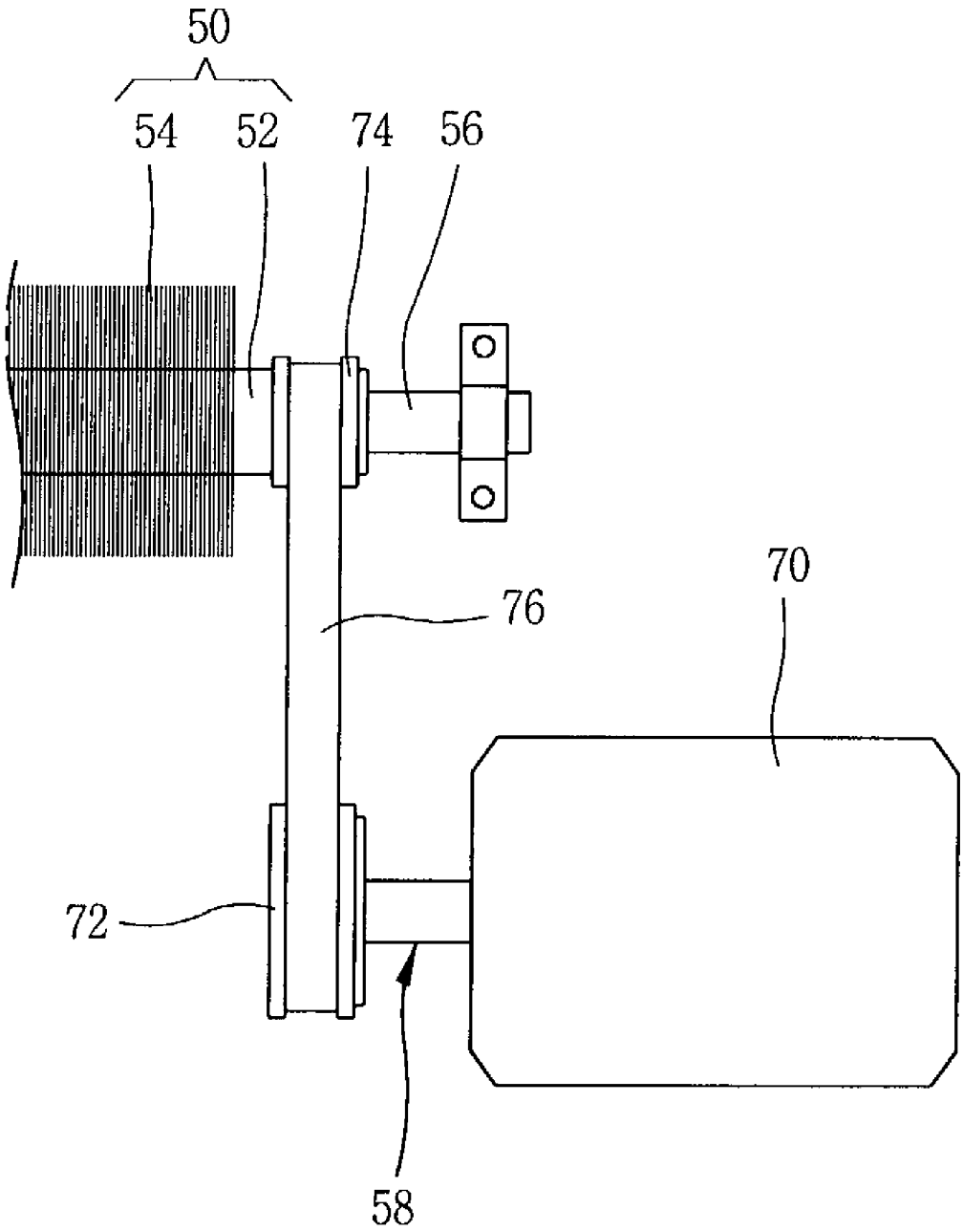
FIG. 5 is a side view illustrating a driving unit of the brush assembly in accordance with an embodiment of the present invention.

FIG. 4 is a sectional view illustrating a structure of a brush assembly taken along the line III—III, and FIG. 5 is a side view illustrating a driving unit of the brush assembly in accordance with the present invention.

The brush assembly 6 includes plural brushes 50 arranged at the bottom surface of the cleaner body 2 radially at regular intervals; plural supporting shafts 56 respectively inserted into the center of the brushes 50 for rotatively supporting the brushes 50; and a driving unit 58 connected to a certain side of the brushes 50 for rotating the brushes 50.

Plural installation grooves 60 for inserting the brushes 50 are formed at the bottom surface of the cleaner body 2 in the circumferential direction of the suction hole 32 at regular intervals. Herein, each installation groove 60 is formed as a certain curved shape having a certain width in order to insert and rotate each brush 50.

Each brush 50 is made of flexible material so as to be transformed with curved shape and be strong against twist, and it consists of a brush hub 52 rotatively inserted into the supporting shaft 56; and plural brush hair 54 arranged on the outer circumference of the brush hub 52 in order to take off filth on the floor and guide it into the suction hole 32.

The both ends of the supporting shaft 56 are fixed to the both sides of the installation groove 60 respectively, and the supporting shaft 56 is formed as a curved shape having a certain radius curvature in order to make the brush 50 maintain the curved shape while being rotated.

Herein, it is preferable to have three brushes 50 arranged radially at an interval of about 120°.

Herein, lubricant 62 is filled between the supporting shaft 56 and the brush hub 52 in order to smooth the rotation of the brush 50.

As depicted in FIG. 5, the driving unit 58 includes a driving motor 70 fixed to a certain side of the cleaner body 2; and a power transmitting unit for transmitting a driving force of the driving motor 70 to the brush 50.

Herein, the power transmitting unit includes a driving pulley 72 fixed to the rotational shaft of the driving motor 70; a driven pulley 74 fixed to a certain side of the outer circumference of the brush hub 52; and a belt 76 connected between the driving pulley 72 and the driven pulley 74 in order to transmit the rotational force of the driving motor 70 to the brush hub 52.

Figure 6:
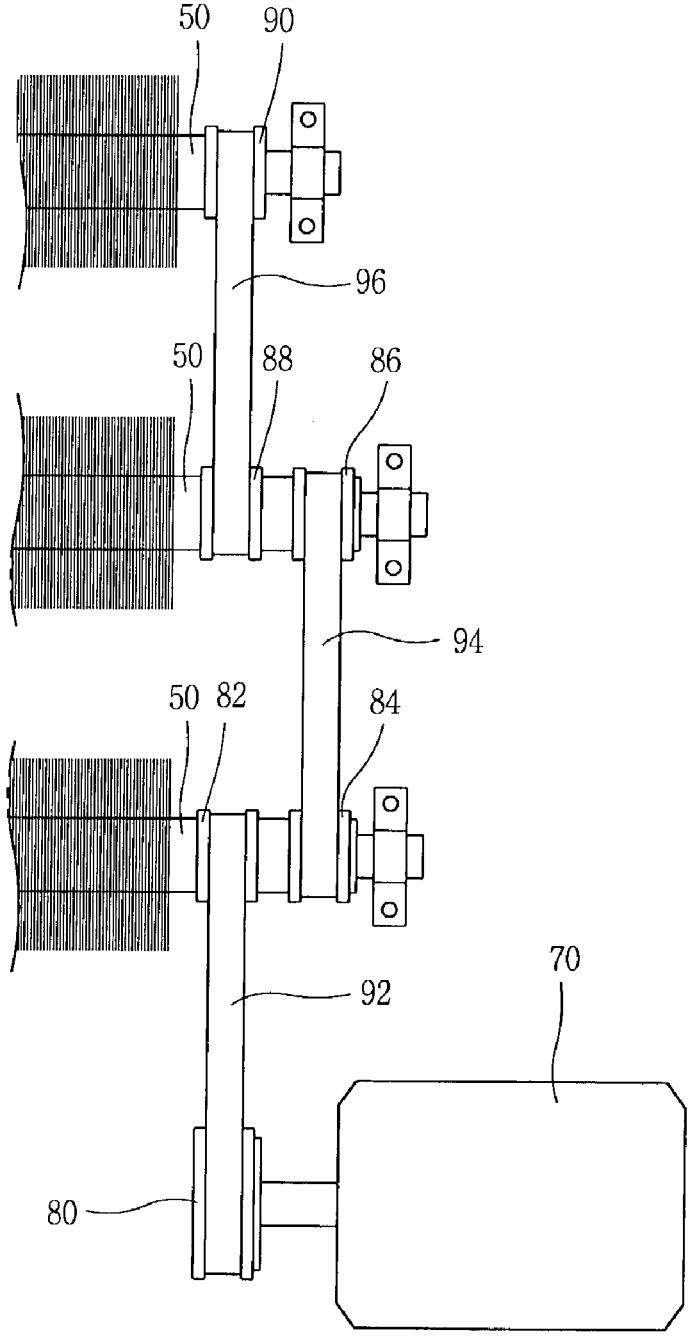
FIG. 6 is a side view illustrating a driving unit of the brush assembly in accordance with another embodiment of the present invention.

As depicted in FIG. 6, in case of driving three brushes 50 by using one driving motor 70, the driving unit 58 includes one driving motor 70; one driving pulley 80 fixed to the rotational shaft of the driving motor 70; driven pulleys 82, 84, 86, 88, and 90 respectively fixed to said three brushes 50; a belt 92 connected between the driving pulley 80 and the driven pulley 82; a belt 94 connected between the driven pulley 84 and the driven pulley 86; and a belt 96 connected between the driven pulley 88 and the driven pulley 90.

The operation of the brush assembly of the cleaner in accordance with the present invention will be described.

When a user turns on an operation switch of the cleaner, power of a charge battery 18 is applied to the suction motor 24, the suction motor 24 is operated, a suction force is generated by the operation of the suction motor 24, and accordingly dust and filth on the floor are sucked and collected into the filter 26 through the suction pipe 30.

And, when the control unit 8 applies power to the driving motor 70, the driving motor 70 is operated. When a driving force of the driving motor 70 is transmitted to the brushes 50 by the power transmitting unit, the brushes 50 are respectively rotated and guide dust and filth on the floor into the suction hole 32.

Herein, because the brushes 50 are arranged at the bottom surface of the cleaner body 2 in the circumferential direction at regular intervals, a cleaning region at which the brushes 50 act is wide, and accordingly a cleaning performance can be improved. In addition, because each brush 50 arranged at the bottom surface of the cleaner body 2 in the circumferential direction has a curved shape, an installation area can be reduced.

The above-described brush assembly of the cleaner is not limited for the robot cleaner but can be used for a general cleaner within its spirit and scope as defined in the appended claims.

In the brush assembly of the cleaner in accordance with the present invention, by arranging plural brushes at the bottom surface of a cleaner body in the circumferential direction at regular intervals in order to guide filth and dust on a floor into a suction hole formed at the center of the cleaner body, a cleaning area of the brushes is wide, and accordingly a cleaning performance can be improved.

In addition, by forming each brush as a curved shape and arranging it at the bottom surface of the cleaner body in the circumferential direction, a brush installation area can be reduced, and accordingly it is possible to reduce a size of the whole cleaner.

What is claimed is:

1. A brush assembly of a cleaner, comprising:

plural brushes arranged at the bottom surface of a cleaner body radially at regular intervals;

plural stationary supporting shafts for rotatably supporting the brushes; and a driving unit connected to the brushes for rotating the brushes, wherein each brush has a curved shape and is made of flexible material so as to be transformed with curved shape and be strong against twist.

2. The brush assembly of claim 1, wherein a suction hole is formed at the bottom center of the cleaner body in order to suck dust and filth, and plural installation grooves are formed at the circumference of the suction hole at regular intervals in order to install the plural brushes.

3. The brush assembly of claim 2, wherein each brush comprises a brush hub rotatably mounted on the supporting shaft; and brush hair arranged on the outer circumference of the brush hub in order to guide dust and filth into the suction hole.

4. The brush assembly of claim 1, wherein the plural brushes comprise three brushes arranged at the bottom surface of the cleaner body in the circumferential direction at regular intervals.

5. The brush assembly of claim 1, wherein the supporting shaft is formed as a curved shape, and both ends thereof are fixed to the bottom surface of the cleaner body.

6. The brush assembly of claim 1, wherein lubricant is filled between the supporting shaft and the brush in order to smooth the rotation of the brush.

7. The brush assembly of claim 1, wherein the driving unit includes a driving motor fixed to a certain side of the cleaner body for generating a driving force; and a power transmitting unit connected between the driving motor and the brush in order to transmit the driving force of the driving motor to the brush.

8. The brush assembly of claim 7, wherein the power transmitting unit includes a driving pulley fixed to the rotational shaft of the driving motor; a driven pulley fixed to the brush; and a belt wound between the driving pulley and the driven pulley.

9. In a robot cleaner having a suction hole formed at the bottom center of a cleaner body, performing cleaning operation while moving by itself and charging a charge battery automatically, a brush assembly of a robot cleaner, comprising:

plural brushes arranged radially in the outer circumferential direction of a suction hole with a certain interval from the suction hole;

plural stationary supporting shafts in which the brushes are inserted respectively in the length direction for supporting the brushes rotatably; and a driving unit connected to the brushes in order to rotate the brushes, wherein each brush has a curved shape and is made of flexible material so as to be transformed with curved shape and be strong against twist.

10. The brush assembly of claim 9, wherein a suction hole is formed at the bottom center of the cleaner body in order to suck dust and filth, and plural installation grooves are formed at the circumference of the suction hole at regular intervals in order to install the plural brushes.

11. The brush assembly of claim 10, wherein each brush comprises a brush hub rotatably mounted on the supporting shaft; and plural brush hair arranged on the outer circumference of the brush hub in order to take off filth on the floor and guide it into the suction hole.

12. The brush assembly of claim 9, wherein the plural brushes comprise three brushes arranged at the bottom surface of the cleaner body in the circumferential direction at regular intervals.

13. The brush assembly of claim 9, wherein the supporting shaft is formed as a curved shape, and both ends thereof are fixed to the bottom surface of the cleaner body.

14. The brush assembly of claim 9, wherein lubricant is filled between the supporting shaft and the brush in order to smooth the rotation of the brush.

15. The brush assembly of claim 9, wherein the driving unit includes a driving motor fixed to a certain side of the cleaner body for generating a driving force; and a power transmitting unit connected between the driving motor and the brush in order to transmit the driving force of the driving motor to the brush.

16. The brush assembly of claim 15, wherein the power transmitting unit includes a driving pulley fixed to the rotational shaft of the driving motor; a driven pulley fixed to the brush; and a belt wound between the driving pulley and the driven pulley.

* * * * *